United States Patent [19]

Crowhurst

[11] 3,995,933

[45] Dec. 7, 1976

[54] OPTICAL SCANNING SYSTEM FOR DIRIGIBLE HEADS

[75] Inventor: James Arthur Crowhurst, St. Albans, England

[73] Assignee: Hawker Siddeley Dynamics Limited, England

[22] Filed: Aug. 6, 1974

[21] Appl. No.: 495,208

[30] Foreign Application Priority Data

Aug. 6, 1973 United Kingdom ..... 37190/73

[52] U.S. Cl. ..... 350/6

[51] Int. Cl.[2] ..... G02B 27/17

[58] Field of Search ..... 350/6, 83; 340/227; 343/5; 250/203 R, 203 CT

[56] References Cited

UNITED STATES PATENTS

| | | | |
|---|---|---|---|
| 2,129,950 | 3/1937 | Gunther | 350/24 |
| 2,184,615 | 12/1939 | Gunther | 350/24 |
| 3,448,272 | 6/1969 | Slater | 350/203 R |
| 3,503,936 | 6/1969 | Slater | 250/203 R |
| 3,603,664 | 9/1971 | James | 350/83 |

*Primary Examiner*—John K. Corbin
*Assistant Examiner*—Ben W. delos Reyes
*Attorney, Agent, or Firm*—Rose & Edell

[57] ABSTRACT

In a mechanism for controlling the movements of a dirigible scanning head, movement about one of three orthogonal axes is imparted to the head by means of a pair of flexible straps which are fastened to the head at opposite sides of said one axis and extend along a part-circular track at the back of the head that is centered on said one axis. The straps are wrapped around respective rollers mounted on a carrier that is itself displaceable in a direction generally along the track by a coupling to an endless flexible band driven by an electric motor-drive. The straps and the drive means for them are carried by the head for rotation with the head relatively to a support member about a second of the three axes.

The straps support conductors for carrying electrical supplies to those units of the scanning head that so require.

4 Claims, 3 Drawing Figures

OPTICAL SCANNING SYSTEM FOR DIRIGIBLE HEADS

This invention relates to the movement and control of dirigible heads such as are provided to carry the optical elements of a scanning optical system. It has particular application to such scanning systems in which the head upon which the optical elements are mounted moves or is displaceable relatively to the field of view; but the invention is not restricted to this use.

It is a primary object of the invention to provide improved mechanical means such as may be employed to controllably direct the optical and associated apparatus of a scanning system with reference to the body member on which such apparatus is mounted.

According to the present invention, there is provided apparatus including a dirigible head that is mounted to be movable angularly about several different axes, wherein the movement about at least a first axis is performed by a pair of flexible elongated members fastened to the head at opposite sides of said first axis.

In one preferred embodiment, the dirigible head, the flexible elongated members, and a drive assembly therefor, are all rotatable relatively to a support member about a second axis at right angles said first axis by drive means such as an annular electric motor centred on said second axis. Preferably also, said dirigible head carries a scanning assembly that is rotatable with respect to said head about a third axis at right angles to both said first and second axes by drive means such as annular electric motor centred on said third axis.

In this way, optical and associated elements of said scanning assembly can be arranged to sweep a hemispherical field of view.

The arrangement further makes possible closely controlled displacement of the scanning assembly, with accurate geometrical positioning relative to said support body throughout the range of displacement.

This embodiment is particularly applicable to a scanning system that is to be used to locate and/or follow a reflective or emissive radiation source.

A further preferred feature of the invention is the transmission of power and control electrical supplies between the movable scanning head and the support body by means of conductors carried by the flexible elongated members.

While in the example to be given there is described apparatus for directing an optical scanning system, the invention is not limited to optics as the same engineering philosophy may be utilised in any scanning device emitting or receiving electromagnetic waves in the visible and invisible wave bands, including X-ray, ultra violet, infra red, radar, laser beam and sound wave radiations.

It is also to be understood that a similar mechanical arrangement may be used to direct a jet of liquid or gas for cutting or working upon a material or may be used to hold a follower tool while a contour is being traced, the form followed being appropriately resolved into its co-ordinate components.

One form of optical scanning apparatus embodying the invention will now be described by way of example with reference to the accompanying drawings, in which.

Figure 1:
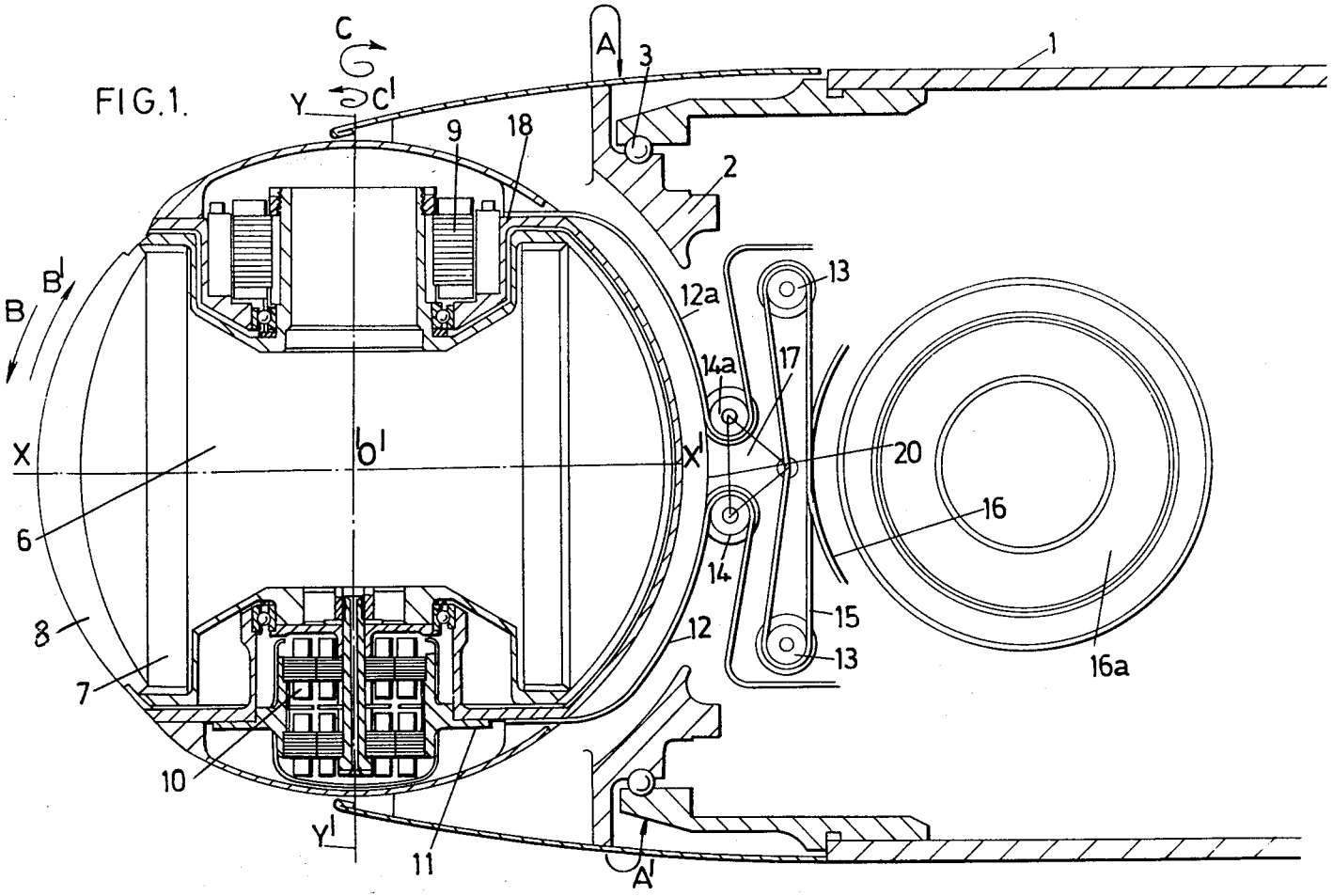
FIG. 1 shows a longitudinal section through the apparatus to be described.
Figure 2:
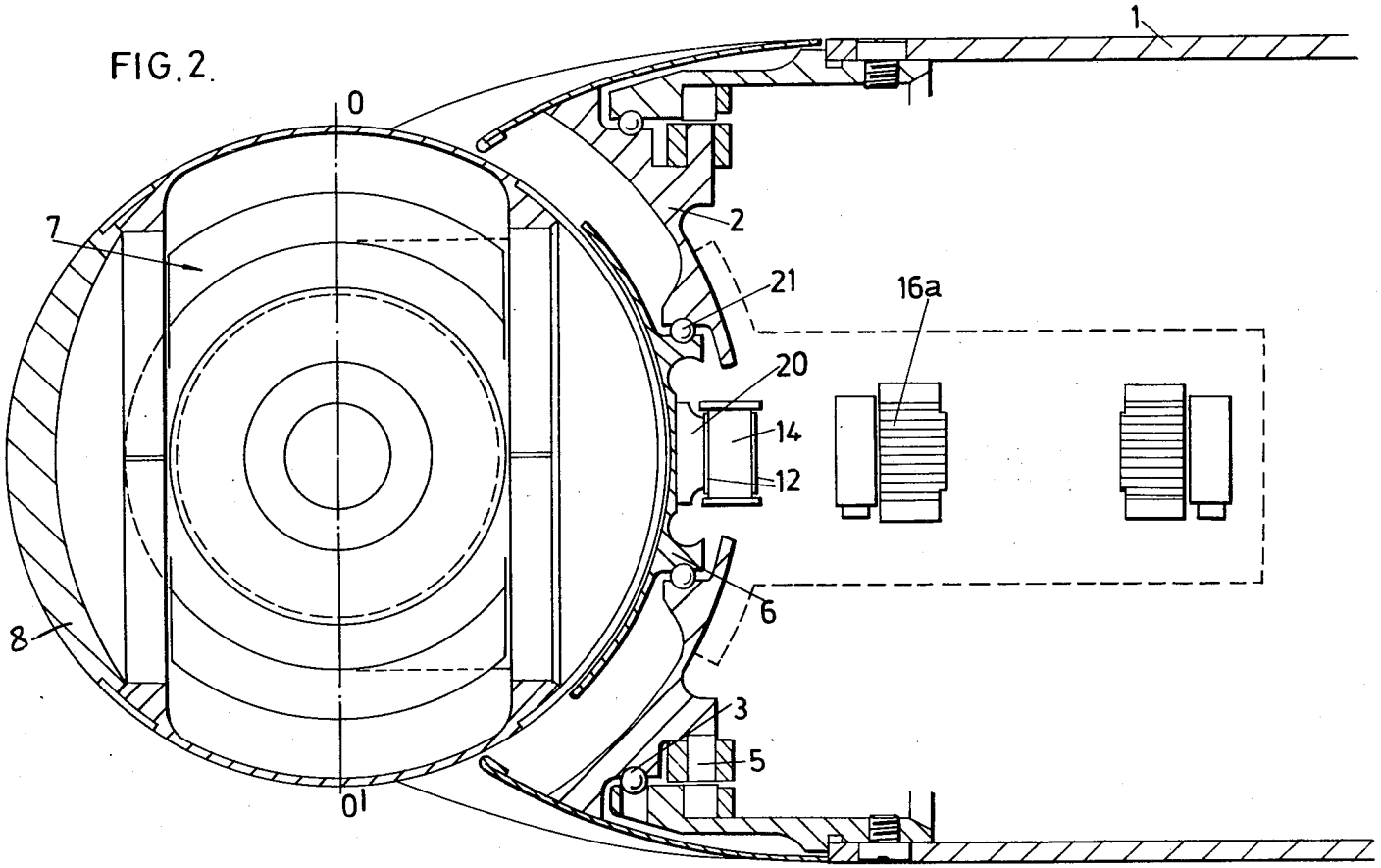
FIG. 2 is a further longitudinal section taken on a plane at right angles to the plane of section in FIG. 1.

Referring to the drawings, a support body 1, which may comprise a mast or elongated structural member carried upon a transportable assembly, e.g. a land vehicle, sea-going vessel, missile, aircraft or ground based installation, has a mounting member 2 rotatably mounted at its end by means of a ball bearing 3 so that said mounting member is free to rotate relatively to the body 1 in the plane of the bearing (being a plane at right angles to the sheet on which FIG. 1 is drawn) about an axis XX′, the direction of rotation being indicated by the arrows A and A′ in FIG. 1. The rotation is under the control of drive means 5 (shown in FIG. 2) which conveniently may be an electric motor of annular form. Held to the mounting member 2 by means later described is a scanning head optical assembly, generally indicated at 6, comprising a housing 7 to which is attached a mounting 18 for a drive means 9 that may again be an annular electric motor and by which the housing 7 can be rotated about an axis YY′ at right angles to the axis X–X′ in the direction of the arrows C and C′ in FIG. 1. Mounted on the same axis YY′ and diametrically opposite said drive means 9 (with respect to the axis XX′) is a resolver unit 10 which is secured to the housing 7 by a flanged ring 11 and displaced angularly about the axis YY′ in correspondence with the angular rotation of the housing 7.

Attached to the flanged ring 11 and the mounting 18 are inextensible flexible tapes or straps 12 and **12*a* respectively which pass around rollers 14 and 14*a* that are mounted on a displaceable member 17 that is pivotally connected to a flexible endless band 15 extending between further rollers 13 and which is wrapped around and can be driven by a drive wheel 16 operated by a motor 16*a*. This drive assembly is carried by the member 2** and is therefore rotatable about the axis X – X′ along with the scanning head.

The scanning head 6 as a whole is mounted on the member 2 by means of a ball bearing assembly 21 that enables it to move angularly about an axis O–O′ at right angles to both the axes X – X′ and Y – Y′. At the region thereof nearest the support body 1, the scanning head 6 bears an arcuate track 20 extending in the plane containing the axes X – X′ and Y – Y′and following a part-circle generated about the axis O – O′ as centre. The rollers **14, 14*a*, and sections of the tapes 12, 12*a*, extending thereto from their points of fastening to the head 6,** lie on this track.

Figure 3:
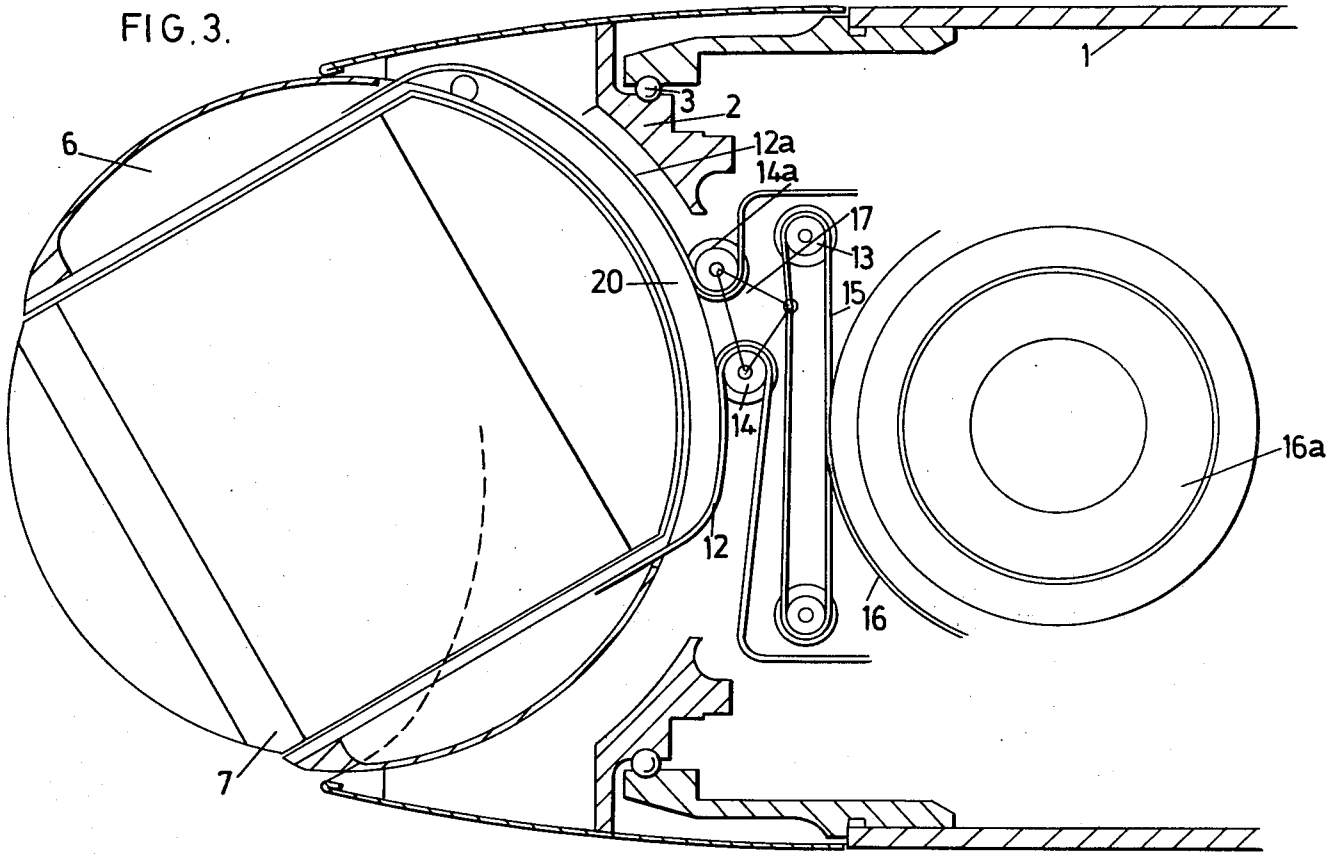
FIG. 3 is a view corresponding to FIG. 1 showing the scanning head in a different angular position.

When the tape 15 is displaced by the drive means 16 then tapes 12 and **12*a* are correspondingly moved causing the assembly of rollers 14, 14*a* on the member 17 to run along the track 20. This results in angular displacement of the head 6 about the axis designated O – O′ as indicated by the arrows B, B′, such displacement being further illustrated in FIG. 3.**

It will be noted that the relative directions of rotation of drive means 16 and head 6, and the driving ratios are such that the masses of the scanning apparatus and the associated drive motor **16*a*** rotate in the same direction and at the same speed thus avoiding undesirable momentum effects.

For reasons of clarity it has been decided to omit details of the power leads to supply the drive motor 9 and the leads whereby signals representative of the angular position of the resolver 10 are taken to appropriate means associated with positional control of the apparatus. However, an advantageous way of accomplishing this is by utilising the tapes 12 and 12*a* as support means for strip wiring capable of carrying the required electrical energy.

It is not proposed to discuss the control system associated with the embodiment described, since any appropriate existing electrical or electronic control may be utilised for the purpose.

Although most of the scanning head optics carried by the housing 7 is not shown, a primary forward-viewing objective lens 8 can be seen mounted on the housing 7 for rotation therewith. While in normal use the lens 8 'looks' forward as shown, a particular feature and advantage of the arrangement described and illustrated is that by rotation of the housing 7 through 108° the lens 8 can be turned inward to a position at the back of the assembly inside the head 6 where it is covered and protected. Consequently, if, for example, the scanning system is fitted to the nose of a guided missile it is not necessary to provide an additional window to shield the lens against erosion damage. The construction is such that the "eyeball" has mobility of displacement over a wide angle (over 180°) thus enabling the lens window to be turned back into the protected position when the missile is being carried by an aircraft prior to launch. Thus erosion impact upon the lens is avoided until the missile system is activated whereupon the lens swings to a forward-looking position.

This environmental protection of the optics has the further advantage that the optical system is not defocussed by having to 'look' through a further protective window which the optics would otherwise "see" as of variable thickness (according to the angle of sight).

Other arrangements are possible without departing from the scope of the invention. For example, where there is sufficient space available the drive means and resolvers may be wholly mounted within the envelope traced by the diameter of the scanning apparatus, the power being provided by an umbilical cord. In an alternative arrangement, a battery pack may be installed within said envelope to supply power.

What I claim is:

1. Apparatus including a generally spherical rotary scanning head for use in a vehicle, said scanning head being mounted to be movable angularly about first, second and third mutually orthogonal axes, said head bearing an arcuate track following a path generated about said first axis as center, said apparatus further comprising:

a support body, flexible elongated elements extending along said track from points of fastening to said head at opposite sides of said first axis, respective rollers about which said elements are wrapped, said rollers being arranged to run along said track as the movement of said head about said first axis takes place, first drive means for driving said rollers along said track, bearing means whereby said scanning head, with said flexible elongated elements and rollers and first drive means, is mounted for rotation, relatively to said support body, about said second axis in a manner to preclude separation of said scanning head from said support body during movement and attitude changes of said vehicle, second drive means centered on said second axis for rotating said scanning head about said second axis, a scanning lens assembly mounted on said scanning head for rotation relatively to said head about said third axis, and third drive means centered on said third axis for rotating said lens assembly about said third axis.

2. Apparatus including a generally spherical rotary scanning head that is mounted to be movable angularly about first, second and third mutually orthogonal axes, said head bearing an arcuate track following a path generated about said first axis as center, said apparatus further comprising a support body, flexible elongated elements extending along said track from points of fastening to said head at opposite sides of said first axis, respective rollers about which said elements are wrapped, said rollers being arranged to run along said track as the movement of said head about said first axis takes place, first drive means for driving said rollers along said track, bearing means whereby said scanning head, with said flexible elongated elements and rollers and first drive means, is mounted for rotation, relatively to said support body, about said second axis, second drive means centered on said second axis for rotating said scanning head about said second axis, a scanning lens assembly mounted on said scanning head for rotation relatively to said head about said third axis, and third drive means centered on said third axis for rotating said lens assembly about said third axis;

wherein said scanning lens assembly comprises an objective lens that faces forward when in use in a direction away from said flexible elements and first drive assembly, which objective lens is rotatable with the lens assembly by said third drive means through substantially 180° about said third axis to bring said lens into a rearward protected position when said scanning lens assembly is not in use.

3. Apparatus according to claim 2, wherein said first drive means comprises a carrier displaceable in a direction generally along said track and on which said rollers are rotatably mounted at spaced positions thereon, an endless band connected to said carrier, and a drive assembly for driving said endless band whereby said carrier is displaced along said track, rotation of said drive assembly in a particular direction producing rotation of said scanning head about said first axis in the same direction and at the same speed.

4. Apparatus according to claim 2, wherein said flexible elongated elements are tapes and are employed as supports for strip electrical wiring.

* * * * *